United States Patent [19]

Gasperin

[11] Patent Number: 4,470,642

[45] Date of Patent: Sep. 11, 1984

[54] KINEMATIC DEVICE FOR DRAWERS, TRAYS AND OTHER PARTS THAT CAN BE EXTRACTED FROM CABINETS AND OTHER FURNITURE

[76] Inventor: Lorenzo Gasperin, Via XXV Aprile, 11 Valera di Va Redo (Milano), Italy

[21] Appl. No.: 384,154

[22] Filed: Jun. 1, 1982

[30] Foreign Application Priority Data

Apr. 7, 1982 [IT] Italy ..... 20627 A/82

[51] Int. Cl.[3] ..... F16C 29/04; A47B 88/10

[52] U.S. Cl. ..... 308/3.8; 312/337

[58] Field of Search ..... 308/3.8, 3.6, 3 R, 6 R; 312/337, 342, 343, 346, 347, 348, 330 R, 330 SM, 334, 331, 341 R, 341 NR

[56] References Cited

U.S. PATENT DOCUMENTS 3,857,618 12/1974 Hagen et al. ..... 308/3.8
3,912,341 10/1975 Stein ..... 308/3.8
3,975,063 8/1976 Mahotka et al. ..... 308/3.8
4,320,934 3/1982 Röck et al. ..... 308/3.6 X

*Primary Examiner*—Stuart S. Levy
*Assistant Examiner*—Thomas R. Hannon
*Attorney, Agent, or Firm*—Michael J. Striker

[57] ABSTRACT

A sliding device for an extractable element in relation to a supporting structure, especially for drawers, trays and the like in cabinets, comprises three rails one above the other: a lower rail being fixed to the supporting structure, an upper one being fixed to the extractable element, and an intermediate rail. All the rails are symmetrical in relation to a central vertical plane of the device. Sets of rollers are placed in pairs on either side of the vertical plane of symmetry of the device between the respective rails. Conterposed racks and a pinion engaged therebetween are provided on the movable rack and the fixed rail. The racks and the pinion extend through the central plane.

6 Claims, 6 Drawing Figures

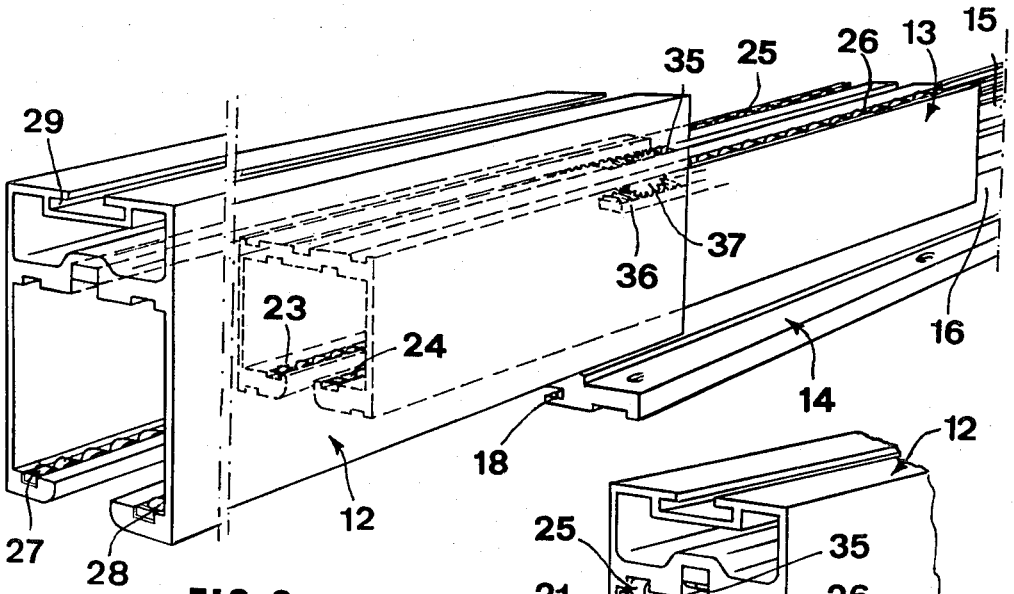
FIG. 3
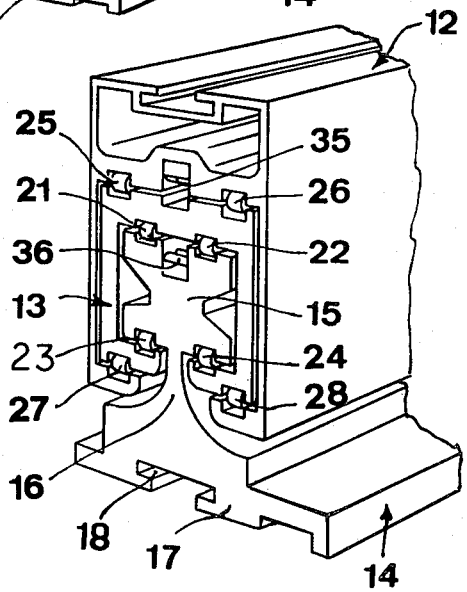
FIG. 4
FIG. 6
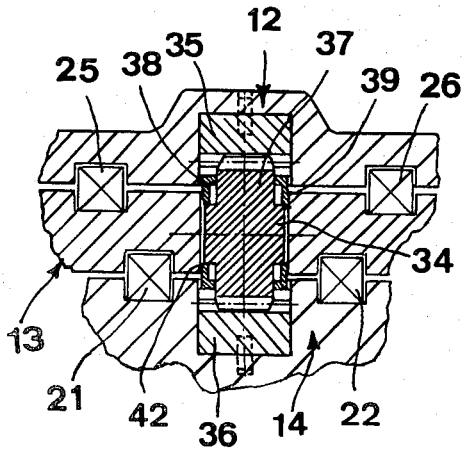
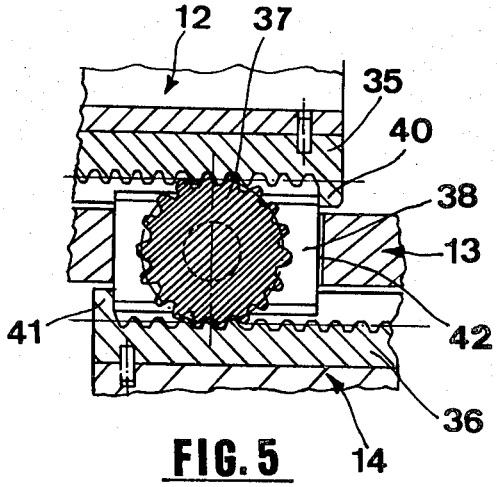
FIG. 5

KINEMATIC DEVICE FOR DRAWERS, TRAYS AND OTHER PARTS THAT CAN BE EXTRACTED FROM CABINETS AND OTHER FURNITURE

BACKGROUND OF THE INVENTION

The devices on which drawers, trays and similar elements slide when pulled out from cabinets etc. are well known.

An intermediate, mobile, supporting runner ensures connection between a drawer, for example, and its place in a cabinet, part of the sliding device being fixed to the cabinet and part to the drawer.

When the drawer is being pulled out, the position of this mobile runner is given by the friction set up by small rollers and similar parts so that, because of the thrust received, of the loads, and of the materials used, sliding characteristics do not remain constant.

Further, since the runners are generally fixed at the side of the extractable part, due to the amount of force applied during the action, they frequently become deformed so that the drawer no longer slides smoothly and evenly.

SUMMARY OF THE INVENTION

The object of the invention is to overcome this trouble.

The object of the invention is attained by a device which assists elements to slide and to project out from the structure in which they are lodged, particularly drawers and trays and similar objects when pulled out and projecting from cabinets; the device is characterized by a kinematic transmission consisting of a rack fixed to the main structure counterposed to a rack fixed to the pulled out part and of a pinion supported by an intermediate guide.

This pinion simultaneously gears into the two racks; it can rotate freely in relation to the supporting intermediate guide but is fixed in translation of the latter.

Translation of the extractable element therefore causes rotation of the pinion and therefore continued translation of the intermediate supporting guide in the same direction for a length equivalent to half that of the stroke made by the extractable element.

The rack is fixed to the housing structure by means of a supporting guide formed by a bar the cross section of which is a kind of two-armed cross fixed, by means of a column, to its base. The intermediate supporting guide consists of a channel the cross section of which is in the form of a squared "C" which envelopes the cross-shaped bar of the supporting guide fixed to the housing structure.

The rack is fixed to the extractable element by a supporting guide consisting of a channel the cross section of which is also a kind of squared "C" which envelopes the "C" shaped channel of the intermediate supporting guide.

Between the upper parts and the counterposing and matching wings of the "C"-shaped channels of the supporting guides of the extractable element and intermediate one, and between the upper part and wings of the channel of the intermediate supporting guide and arms of the cross of the supporting guide fixed to the housing structure, counterposed and matching, are fixed a series of roller bearings placed there to facilitate the sliding motion.

It is proposed to use a pair of devices, such as those described, each placed in proximity to the sides of the extractable element so that all the forces brought to bear on that element meet symmetrical reactions from one side and the other of the central vertical plane of the element itself thus ensuring the maximum effect both of a guide and of a secure support.

The characteristics and purposes of the invention will appear even clearer from the following example of its execution illustrated by diagrams.

BRIEF DESCRIPTION OF THE DRAWINGS

Application of the invented device to a pull-out tray.

FIG. 3 shows the device subject of the invention, in open position;

FIG. 4 shows the device subject of the invention, in closed position;

FIG. 5 shows a detail, of the device cut through longitudinally; and

FIG. 6 shows a detail, of the device cut through transversely.

DETAILED DESCRIPTION OF THE PREFERRED EMBODIMENTS

Figure 1:
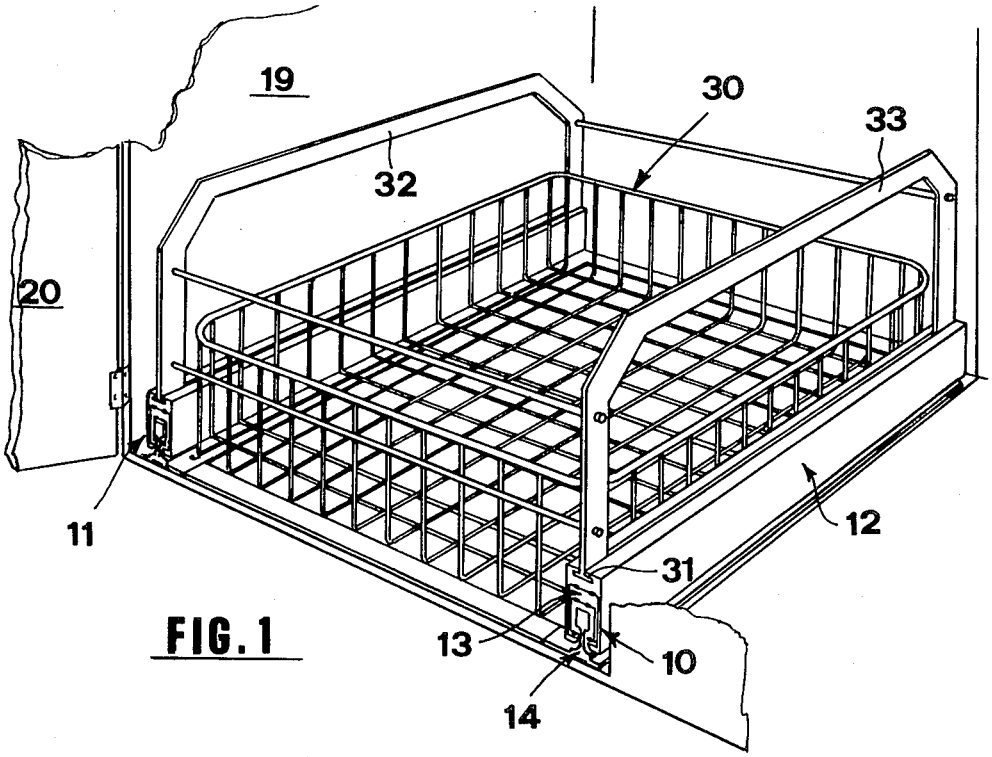
FIG. 1 shows the tray mounted in a cabinet fitted with the devices subject of the invention.
Figure 2:
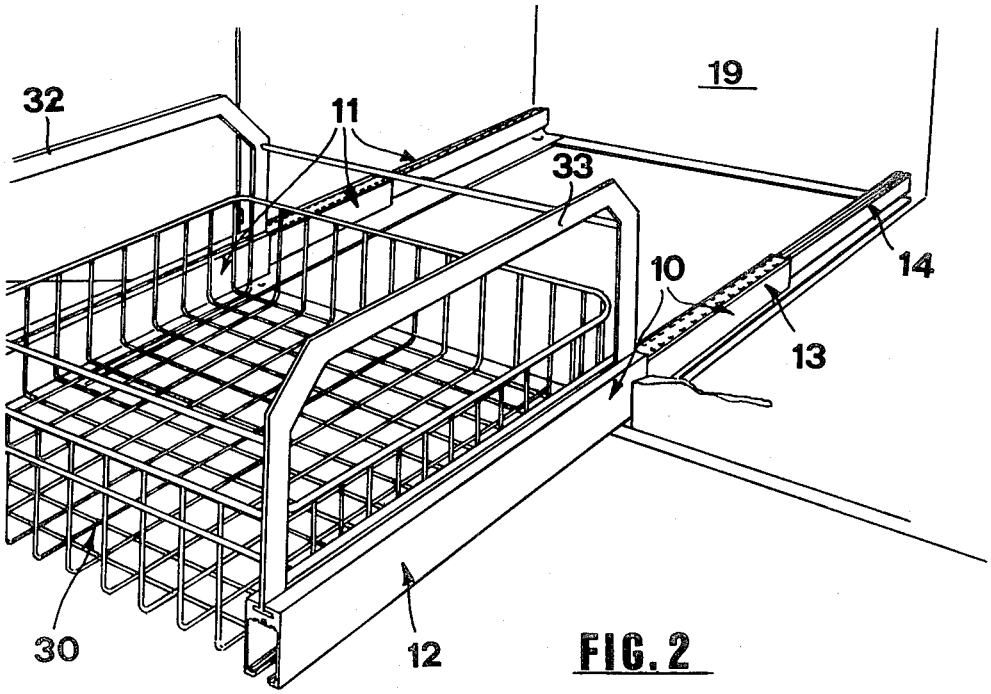
FIG. 2 shows the tray pulled out.

The devices (10) and (11) comprise the guides formed by the upper recessed guides (12), to be applied to the tray (30), the lower guides (14), to be applied to the cabinet (19), and intermediate guides (13). The guide (14) consists of a bar (15) in the form of a double cross fixed, by means of a central column (16), to the base (17) in which there is a longitudinal groove (18) for application thereto of a T-shaped bar fixed to the cabinet (19) with door (20).

The intermediate guide (13) has a channel in the form of a square "C" facing downwards, the cross section of which corresponds to that of the bar (15) in such a way that the upper part is counterposed to the upper arm of the cross, while the lower wings are counterposed to the lower arm of the same cross. Two pairs of roller bearings (21) (22) and (23) (24) are situated in the zones of counterposition.

The form given to the upper guide (12) is also that of a "C" similar to the "C" of the intermediate guide which it almost completely surrounds. The two sets of rollers, (25) and (26) above and (27) and (28) below are similarly placed in the zones of counter-position. In the upper guide there is a recess (29) in which the "T" bar (31), fixed to the sides (32) and (33) of the tray (30), can be fitted.

The kinematic transmission movement includes the parallel racks (35) fixed to the upper guide and (36) fixed to the lower guide, as well as the pinion (37) which gears into both of them.

The side pins (34) in the pinion can revolve freely in the supporting plates (38) and (39) on each side, inserted in the holes (42) of the intermediate guide (13), see FIG. 6. The plates guide the pinion and also function as end-stops on the final notches (40) and (41) of the racks.

The device operates very simply. Movement of the tray causes translation and rotation of the pinion which, operating on the rack fixed to the cabinet, sets up dynamic thrust on the tray itself, this thrust being equivalent to a stroke which is double that of the pinion.

The intermediate guide, moving in line with the pinion, extends when the tray is pulled out but only for half that length. At the end of the stroke, when the tray is almost entirely projecting, the intermediate guide will be projecting for about half the length of the tray which is thus adequately supported by it.

The advantages of the invention are clear.

By means of the pinion and rack system, the extractable element is dynamically supported for an increasing length exactly proportional to the extent of its projection, this function being carried out with precision and safety.

The transmission ratio of 1:2 which is set up between translation of the pinion and that of the extractable element, causes multiplication of the thrust generated by the hand on the extractable element creating a dynamic effect which considerable increases sensibility and the easy sliding movement.

The position given to the elements of reaction in relation to the acting forces, practically speaking on the same vertical plane as these forces, prevents the guides from giving way and thus dislocation of the extractable element.

As application of the invention has been described as an example in no way limited to this, it is understood that any equivalent application of the inventive concepts described and any product executed and/or operating in accordance with the characteristics of the invention, will be covered by its field of protection.

I claim:

1. A sliding device for an extractable element to be pushed in or pulled out in relation to a supporting structure to be used for drawers, trays and the like in cabinets, the device having a vertical central plane and comprising a stationary rail to be fixed to the supporting structure and formed with a first rack; a movable rail to be fixed to the extractable element and formed with a second rack counterposed to said first rack; an intermediate rail provided with a pinion engaged with said first rack and said second rack, said movable rail surrounding said intermediate rail from above, said intermediate rail surrounding said stationary rail from above; said movable rail, said intermediate rail and said stationary rail being aligned relative to said central plane and symmetrically positioned thereto; first means positioned at the top of said movable rail for fixing said movable rail to the extractable element; and second means positioned at the bottom of said stationary rail for fixing said stationary rail to the supporting structure to thereby ensure alignment of forces acting on the extractable element and forces of reaction from the supporting structure and thus ensure smooth operation of the device and reduced stresses on the rails during operation, said first rack, said pinion and said second rack extend through said central plane, said pinion being adapted to rotate about a horizontal axis; and rolling means arranged in prallel sets between said movable rail and said intermediate rail, and said stationary rail and said intermediate rail, respectively, the rolling means in each set being arranged in pairs and disposed so that one rolling means of each pair is symmetrical to another rolling means of the said pair with respect to said central plane, said rolling means preventing direct contact between the respective rails.

2. The device as defined in claim 1, wherein said rolling means are rollers.

3. The device as defined in claim 1, wherein said rolling means are balls.

4. The device as defined in claim 1, wherein said stationary rail is formed as an elongated bar of a cross-shaped cross-section, which has two pairs of horizontal arms and a base of a widened cross-section to be fixed to the supporting structure, said intermediate rail being formed as an elongated bar of C-like shape facing downwards and having an upper horizontal portion and lower end portions facing inwardly and embracing said stationary rail, and said movable rail being formed as an elongated bar of C-like shape facing downwards and having an upper horizontal portion and lower end portions facing inwardly and embracing said intermediate rail.

5. The device as defined in claim 3, wherein said movable rail, said intermediate rail and said stationary rail have faces counterposing each other, respectively, each of said rails being formed with longitudinal grooves at said faces, said rolling means being positioned in respective grooves of said rails.

6. The device as defined in claim 5, wherein said movable rail has at the top thereof a longitudinal recess of horizontal C-like cross-section and is adapted to receive a portion of said first means for fixing the movable rail to the extractable element, said stationary rail having at the bottom thereof a longitudinal recess of horizontal C-like cross-section and being adapted to receive a portion of said second means for fixing the stationary rail to the supporting structure, said portions of the first and second means, respectively, being of T-shape cross-section.

* * * * *